US011674669B2

(12) United States Patent
Preutz

(10) Patent No.: US 11,674,669 B2
(45) Date of Patent: Jun. 13, 2023

(54) LIGHTING DEVICE WITH RELEASABLY CONNECTED SHADE

(71) Applicant: IKEA SUPPLY AG, Pratteln (CH)

(72) Inventor: Henrik Preutz, Älmhult (SE)

(73) Assignee: IKEA SUPPLY AG, Pratteln (CH)

( * ) Notice: Subject to any disclaimer, the term of this patent is extended or adjusted under 35 U.S.C. 154(b) by 0 days.

(21) Appl. No.: 16/334,309

(22) PCT Filed: Sep. 7, 2017

(86) PCT No.: PCT/SE2017/050885
§ 371 (c)(1),
(2) Date: Mar. 18, 2019

(87) PCT Pub. No.: WO2018/052360
PCT Pub. Date: Mar. 22, 2018

(65) Prior Publication Data

US 2019/0219250 A1 Jul. 18, 2019

(30) Foreign Application Priority Data

Sep. 19, 2016 (SE) ..... 1651239-4

(51) Int. Cl.
*F21V 17/00* (2006.01)
*F21S 8/06* (2006.01)
(Continued)

(52) U.S. Cl.
CPC ..... *F21V 17/002* (2013.01); *F21S 8/06* (2013.01); *F21S 9/03* (2013.01); *F21S 9/037* (2013.01); *F21V 1/06* (2013.01); *F21V 1/16* (2013.01); *F21V 3/023* (2013.01); *F21V 17/06* (2013.01); *F21V 21/08* (2013.01); *F21V 17/10* (2013.01)

(58) Field of Classification Search
CPC ..... F21V 17/002; F21V 17/06; F21V 17/10; F21V 17/102; F21V 1/06; F21V 21/08; F21V 3/023; F21V 1/02; F21V 1/04; F21V 1/08; F21V 1/143; F21V 1/146;
(Continued)

(56) References Cited

U.S. PATENT DOCUMENTS 515,385 A 2/1894 Ward
D47,607 S 7/1915 Owen
(Continued)

FOREIGN PATENT DOCUMENTS

CN 102175010 A 9/2011
CN 204313159 U 5/2015
(Continued)

OTHER PUBLICATIONS

International Search Report and Written Opinion for PCT/SE2017/050885, dated Nov. 24, 2017.
(Continued)

*Primary Examiner* — Erin Kryukova
(74) *Attorney, Agent, or Firm* — Merchant & Gould P.C.

(57) ABSTRACT

The invention provides a lighting device (1) comprising a housing (2) including a solar-power unit and a lighting element, and a shade (3) connected to the housing (2), wherein the shade (3) is releasably connected to the housing (2) and loosely rests on an external surface of the housing (2) when connected thereto.

18 Claims, 7 Drawing Sheets

(51) Int. Cl.

| | |
|---|---|
| ***F21V 1/06*** | (2006.01) |
| ***F21V 17/06*** | (2006.01) |
| ***F21V 21/08*** | (2006.01) |
| ***F21V 1/16*** | (2018.01) |
| ***F21S 9/03*** | (2006.01) |
| ***F21V 3/02*** | (2006.01) |
| ***F21V 17/10*** | (2006.01) |

(58) Field of Classification Search
CPC ..... F21V 1/16; F21S 9/03; F21S 9/037; F21S 8/06; F21L 4/08
See application file for complete search history.

(56) References Cited

U.S. PATENT DOCUMENTS

| | | | | |
|---|---|---|---|---|
| D90,939 | S | 10/1933 | Beck | |
| D102,906 | S | 1/1937 | Lescaze | |
| 3,253,137 | A * | 5/1966 | Richter, III | F21V 3/023 362/293 |
| 3,778,611 | A * | 12/1973 | Burridge | F21V 1/26 362/351 |
| 4,118,762 | A * | 10/1978 | Fennell | F21V 3/00 362/311.13 |
| 5,685,635 | A * | 11/1997 | Barthelmess | F21V 3/00 362/123 |
| 5,791,773 | A * | 8/1998 | Babineaux | F21V 1/06 362/16 |
| 5,868,490 | A * | 2/1999 | Barthelmess | F21S 4/10 362/227 |
| 5,893,636 | A * | 4/1999 | Babineaux | F21V 1/06 362/352 |
| D441,483 | S | 5/2001 | Shaefer | |
| 6,315,434 | B1 | 11/2001 | Long | |
| 6,981,785 | B1 * | 1/2006 | Watchulonis | F21V 1/06 362/352 |
| 7,073,919 | B1 * | 7/2006 | Masina | F21S 8/081 362/153.1 |
| D680,257 | S | 4/2013 | Patrick | |
| 8,657,461 | B2 | 2/2014 | Allsop et al. | |
| D779,104 | S | 2/2017 | Krueckeberg | |
| D800,364 | S | 10/2017 | Lee | |
| D812,283 | S | 3/2018 | Amdt | |
| 2005/0105293 | A1 * | 5/2005 | Hsu | F21V 1/06 362/352 |
| 2005/0146874 | A1 * | 7/2005 | Cech | F21S 8/081 362/253 |
| 2006/0098445 | A1 * | 5/2006 | Lasch | F21V 17/12 362/407 |
| 2006/0279956 | A1 * | 12/2006 | Richmond | F21V 15/01 362/374 |
| 2008/0175006 | A1 * | 7/2008 | Kellmann | F21S 9/037 362/360 |
| 2009/0175034 | A1 * | 7/2009 | Allsop | F21S 9/037 362/183 |
| 2012/0134143 | A1 | 5/2012 | Lederer | |
| 2012/0281393 | A1 | 11/2012 | Allsop et al. | |
| 2013/0094191 | A1 | 4/2013 | Cohen | |
| 2013/0223049 | A1 | 8/2013 | Katsaros | |
| 2014/0022773 | A1 | 1/2014 | Colby | |
| 2014/0055988 | A1 * | 2/2014 | Cohen | F21V 1/06 362/183 |
| 2014/0133138 | A1 * | 5/2014 | Chang | F21V 3/00 362/158 |
| 2015/0077980 | A1 * | 3/2015 | Coughlin | F21V 21/14 362/183 |
| 2017/0089551 | A1 | 3/2017 | Xu | |
| 2017/0205052 | A1 * | 7/2017 | Mastenbroek | F21S 8/061 |
| 2017/0205059 | A1 * | 7/2017 | Yang | F21V 21/104 |
| 2018/0195709 | A1 | 7/2018 | Wang | |

FOREIGN PATENT DOCUMENTS

| | | | |
|---|---|---|---|
| CN | 205065506 | U | 3/2016 |
| CN | 106439715 | A * | 2/2017 |
| EP | 2244008 | A1 | 10/2010 |
| EP | 2960571 | A1 | 12/2015 |
| KR | 20120101958 | A * | 9/2012 |
| KR | 20150002797 | U * | 7/2015 |
| KR | 20150002797 | U | 7/2015 |
| WO | 2018052360 | | 3/2018 |

OTHER PUBLICATIONS

International Preliminary Report on Patentability for PCT/SE2017/050885, dated Dec. 21, 2018.
Chinese Office Action for Chinese Application No. 20170056665.6 dated Mar. 13, 2020 (English Translation included), 17 pages.
Notice of Allowance for U.S. Appl. No. 29/623,035 dated Jul. 15, 2019 (6 pages).
Zider Solar Camping Light Outdoor Hanging Lamp. Available at amazon.com as early as Apr. 23, 2018.
Portable Solar Power LED Bulb Light Hanging camping Hiking Lantern, from lightinghouse.net visited Jul. 1, 2019 (https://lightinghouse.net/product/solar-garden-lights/solar-hanging-light).
60 LED SOS Mode Emergency Survival Hanging Solar Light Outdoor Garden Camping Lamp FULI—Model No. 112691, from aliexpress.com visited Jul. 1, 2019.
Extended European Seach Report for EP Application No. 17851179.6 dated Feb. 14, 2020 (8 pages).

* cited by examiner

LIGHTING DEVICE WITH RELEASABLY CONNECTED SHADE

This application is a National Stage Application of PCT/SE2017/050885, filed 7 Sep. 2017, which claims the benefit of priority to Swedish Patent Application No. 1651239-4, filed 19 Sep. 2016, which applications are incorporated herein by reference. To the extent appropriate, a claim of priority is made to each of the above disclosed applications.

The invention relates to a lighting device, particularly a solar-powered lighting device.

Such lighting devices are known in different forms. An example of a solar-powered collapsible lighting apparatus is disclosed in U.S. Pat. No. 8,657,461 B2. In this known lighting apparatus, the shade is fixed to a housing that receives a solar cell, a battery, and at least a portion of a lighting-element assembly. The shade is particularly clamped to the housing so that detaching the shade from the housing is not easily possible.

It might be desirable, however, to replace the shade, for instance if the shade is damaged or a differently colored shade is desired.

A solar-powered hanging lantern with a removable, interchangeable shade is known from US 2014/0055988 A1. When the shade is connected to the housing, i.e. in the assembled state, an elastomeric ring is used to fix the shade to the housing. Thus, replacing the shade is complicated by the need of handling the elastomeric ring.

It is, thus, an object of the present invention to provide a lighting device that can be used more flexibly.

This object is achieved with a lighting device according to claim 1. Preferred embodiments are specified in the dependent claims.

According to the invention, the shade is releasably connected to the housing, wherein the shade loosely rests on an external surface of the housing when connected thereto. Consequently, it is possible to remove the shade by simply lifting it from the housing. This is particularly possible without the use of any tools. Thus, the shade can be flexibly replaced so that the lighting device can be used, for instance, with differently colored shades. Expertise or skills in handling tools is thereby not needed for a layman that wants to replace the shade.

The expression "loosely rests" is to be understood such that the shade rests on the external surface of the housing without being fixed thereto by any kind of fixing element or fastener. Thus, the shade can be removed or lifted from the external surface of the housing without the need to release any fixing element or fastener beforehand and without the use of any tools.

The shade may be kept attached to the external surface of the housing because of gravity, when in use. In other words, the shade is not fixed to the housing by any kind of fixing element or fastener but only loosely rests on an external surface of the housing when connected thereto in an assembled state.

The housing may be configured to receive the solar-power unit and the lighting element.

The solar-power unit may comprise at least one solar cell. The solar-power unit may be arranged within the housing such that the at least one solar cell is arranged at an upper surface of the housing. In other words, the at least one solar cell of the solar-power unit may face outwardly from the housing at a top surface thereof. For that purpose, the housing may particularly comprise an opening in which the at least one solar cell of the solar-power unit is at least partly arranged.

The expressions "upper surface" or "top surface" refer herein to the orientation of the housing when in use. The top or upper surface of the housing may particularly be the surface of the housing facing away from the interior of the shade in the assembled state.

The solar-power unit may further comprise at least one rechargeable battery connected to and chargeable by the at least one solar cell. The at least one rechargeable battery may also be electrically connected to the lighting element so that the lighting device may be powered by the at least one rechargeable battery.

The lighting element may particularly comprise one or more light-emitting diodes (LEDs). Other types of lighting elements, however, are conceivable as well. For instance, the lighting element may correspond to or comprise a low-voltage incandescent light bulb.

The housing may comprise a transparent surface section, wherein the transparent surface section and the lighting element are arranged such that light emitted by the lighting element can be output via the transparent surface section. The transparent surface section may particularly project from an otherwise planar surface of the housing.

Alternatively, the lighting element itself may partly project from an outer surface of the housing.

The transparent surface section or the lighting element projecting from a surface of the housing may particularly be arranged at a side of the housing facing towards the interior of the shade, or, in other words on the lower surface of the housing when the lighting device is in use. The transparent surface section or the projecting lighting element may particularly be arranged inside the shade.

The lighting device may further comprise a switch for activating or deactivating the lighting element. The switch may be arranged at an outer surface of the housing. The switch may particularly be configured such that an electric connection between the solar-power unit and the lighting element can be established or interrupted.

A light sensor may be provided alternatively or additionally to the switch to activate and/or deactivate the lighting element dependent on the ambient lighting conditions. The light sensor may be arranged at an upper surface of the housing.

The shade may particularly rest on a rim projecting from a side of the housing. The rim may be a continuous rim completely surrounding the housing. Alternatively, the rim may be interrupted so that the rim is only provided in predetermined sections along the circumference of the housing.

The side of the housing may refer to a surface area of the housing connecting the side of the housing facing the interior of the shade and the side of the housing facing away from the interior of the shade. In other words, the housing may comprise an upper surface, a lower surface and a side surface, wherein the rim may project from the side surface.

The side of the housing may taper, in particular, conically, in a direction away from the rim. The side of the housing may particularly taper upwards or, in other words, in a direction away from the interior of the shade. The tapering allows more easily mounting the shade to the housing while allowing for a secure fit when the shade is in its mounted position.

The shade may alternatively rest on a tapering side surface of the housing. In this case, a rim may be omitted, and, thus, material may be saved.

The extension of the housing on a side of the rim facing the interior of the shade may be larger than the extension on a side facing away from the interior of the shade. In other words, the rim may be provided in an upper part, particularly an upper third, of a side surface of the housing.

Alternatively, the rim may also be provided in a lower part, particularly a lower third, of the side surface of the housing. In this case, the extension of the housing on a side of the rim facing the interior of the shade may be smaller than the extension on a side facing away from the interior of the shade.

The housing may particularly have a cylindrical or conical shape. The rim may project from a side of the cylindrical or conical housing.

The shade may particularly loosely rest on the external surface of the housing via a mounting element of the shade. In particular, the mounting element may contact the external surface of the housing in the assembled state. The remainder of the shade connected to the mounting element is then supported on the external surface of the housing by the mounting element. The mounting element may particularly be part of a supporting structure of the shade. The supporting structure of the shade may be a rigid structure to which the fabric of the shade is connected so that the shade maintains its desired shape. It is also possible, however, that the mounting element is an element distinct from but connected to the supporting structure of the shade. The mounting element may particularly surround or be arranged within a top opening of the shade.

The shape of the mounting element may be adapted to the shape of the external surface of the housing so that the mounting element continuously touches the external surface in the assembled state. For instance, the mounting element may be a ring-shaped element if the external surface has a cylindrical or conical shape. Alternatively, the shape of the mounting element may differ from the shape of the external surface of the housing. In this case, the mounting element may touch the external surface in the assembled state only in separated points or areas.

The mounting element may be spaced from the supporting structure of the shade. For instance, the mounting element may be connected to the supporting structure of the shade via one or more, particularly three, struts. In this way, the wear on the fabric may be decreased as it is no longer in contact with the housing. Moreover, a more well-defined position of the mounting element with respect to the housing is possible as there is no involvement of the fabric there. Finally, the space between the mounting element and the supporting structure of the shade offers a possibility for rain water to drain between the mounting element and the fabric of the shade.

The mounting element may be continuous or interrupted. In the latter case, the mounting element may comprise distinct parts, each being connected individually or in combination with the remaining parts to the support structure of the shade.

The lighting device may further comprise a suspension assembly for suspending the lighting device from a surface, such as a ceiling, wherein the suspension assembly is connected to the housing. The lighting device, thus, may be a pendant luminaire.

The suspension assembly may particularly comprise a hook connected to the housing via at least one, particularly via three cords.

Alternatively to the hook, a different hanging device may be provided, for instance in the form of a loop, which may cooperate with a ceiling hook, for instance, mounted to a ceiling or a similar surface.

The lighting device may particularly comprise three or more cords, wherein the three or more cords are connected to the housing in a surface area surrounding at least one solar cell of the solar-power unit. The three or more cords may then converge towards the hanging device or hook provided in connection with the cords.

The suspension assembly may comprise at least one directing structure adapted for directing the shade towards the external surface, such as a rim or a conical surface, of the housing. The directing structure may be part of and/or may comprise at least one cord forming part of the suspension assembly. The cord may be arranged adjacent to the external surface.

The shade may have a top opening and a bottom opening, wherein the housing is arranged at least partly within the top opening and wherein the size of the bottom opening is larger than the size of the top opening. In this way, the housing may be introduced into the shade via the bottom opening and the shade may then loosely rest on an external surface of the housing arranged at the top opening of the shade. The above-mentioned mounting element of the shade may particularly be formed such as to surround the top opening of the shade.

The expressions "top" and "bottom" refer in this context again to the orientation of the lighting device, particularly of the shade, when in use.

The shade may particularly be a collapsible shade. For this purpose, the shade may comprise a supporting structure to which the actual shade fabric is mounted, in particular, releasably mounted in a non-destructible way. The shade fabric may be made of a material such as silk, linen, cotton, plastic or paper. The supporting structure may be made of metal or a plastic material.

The above-mentioned mounting element of the shade may be part of the supporting structure. As mentioned above, however, it is also possible that the mounting element is an element distinct from but connected to the supporting structure of the shade.

The shape of the shade is not particularly limited. For instance, the shade may be spherical. However, it is also possible for the shade to be square, hexagonal, oval, or any other appropriate shape.

The support members of the shade may be circular but could also have other shapes, such as square, rectangular, oval, triangular etc. depending on the desired shape of the shade. The design of the housing may be adapted to the shape of the support members. Similarly, the shape of the mounting element may be adapted accordingly to the shape of the support members.

The shade may be collapsible such that in the collapsed state, the extension of the shade in at least one direction is less than in the uncollapsed state. For instance, a spherical shade may have the form of a disc in the collapsed state.

Advantageous embodiments will now be described in combination with the enclosed figures.

Figure 1A:
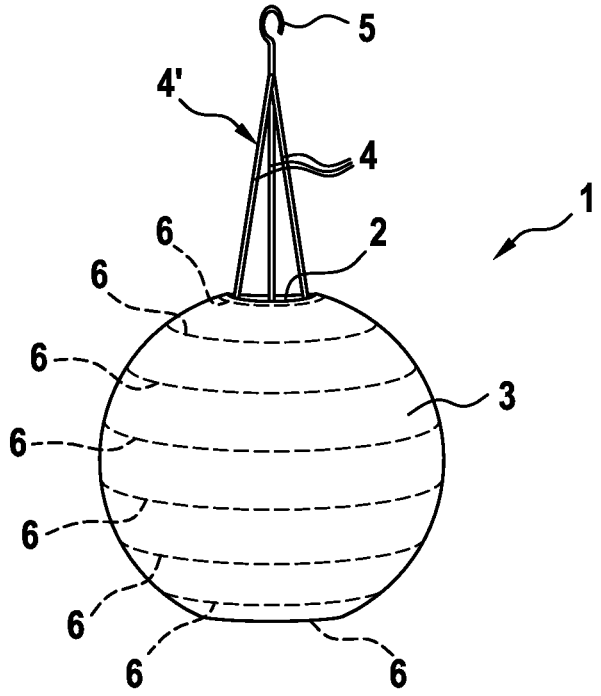
FIGS. 1A and 1B show a perspective view and a cross-section, respectively, of a lighting device according to an embodiment of the invention.

FIG. 1A shows a perspective view of an exemplary lighting device 1 according to an embodiment of the invention in an assembled state, i.e. ready to be suspended from a ceiling or similar structure. FIG. 1A, thus, shows the lighting device 1 in its configuration when in use. The lighting device 1 comprises a housing 2 of which only the top surface is visible in FIG. 1A. At the top surface, solar cells of a solar-power unit received by the housing are arranged. The housing 2 further includes a lighting element that is not visible from FIG. 1A since it is arranged inside the shade 3. Connected to the housing 2 are three cords 4 being part of a suspension assembly 4' for suspending the lighting device 1, e.g., from a ceiling. The cords 4 are connected with a hook 5. Instead of the hook, a different hanging device may be provided as well, for instance, a hanging loop.

The shade 3 comprises a supporting structure including a plurality of ring-shaped support members 6. In the embodiment of FIG. 1A, a number of individual and circular ring shaped support members 6 are shown. As alternative a spiral shaped supporting structure may be used for the shade. Furthermore, the support members need not be circular but could have other shapes, such as square, rectangular, oval, triangular etc. depending on the desired shape of the shade. In case the support members have another shape than circular then preferably the design of the housing is adapted accordingly. Mounted to said ring-shaped support members 6 is the actual shade fabric, which may be made of silk, linen, cotton, plastic, paper, or the like. The shade fabric is flexible. Thus, the shade 3 is collapsible from the spherical shape shown in FIG. 1A to a disc-like shape. This disc-like shape is illustrated in FIG. 1D in which the shade 3 is shown in its collapsed, i.e. flat, state.

The shade fabric is at least partly transparent and may be colored and/or textured. Although FIG. 1A shows a spherical shape of the shade 3, other shapes are conceivable as well, such as, for instance, the shape of a box or of a hexagon.

Figure 1B:
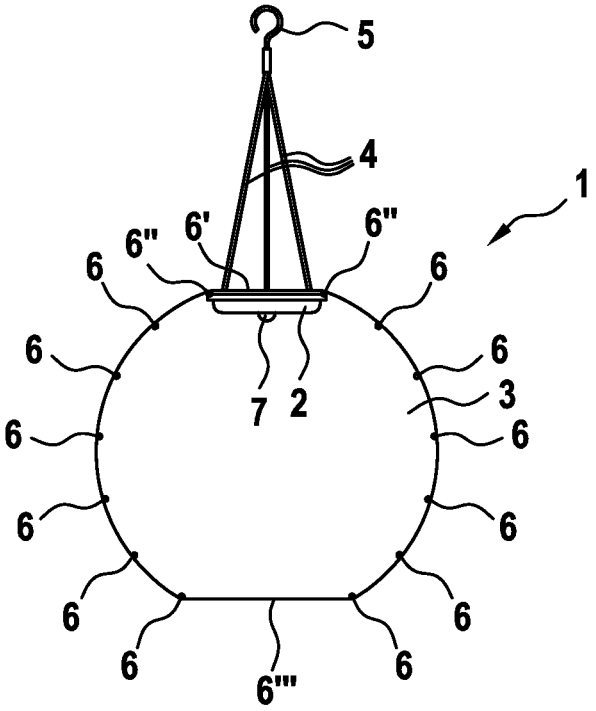
Figure 1C:
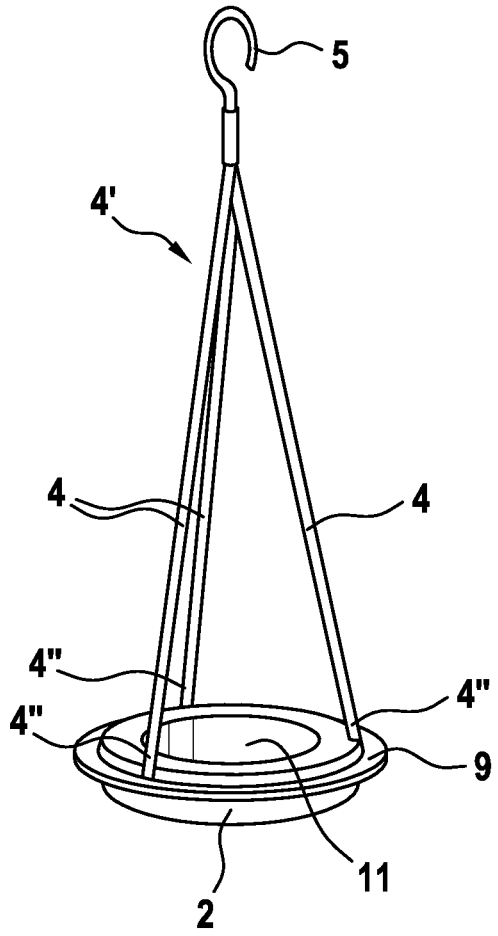
FIGS. 1C and 1D show a housing of the lighting device in isolation, and a shade of the lighting device in collapsed state.
Figure 1D:
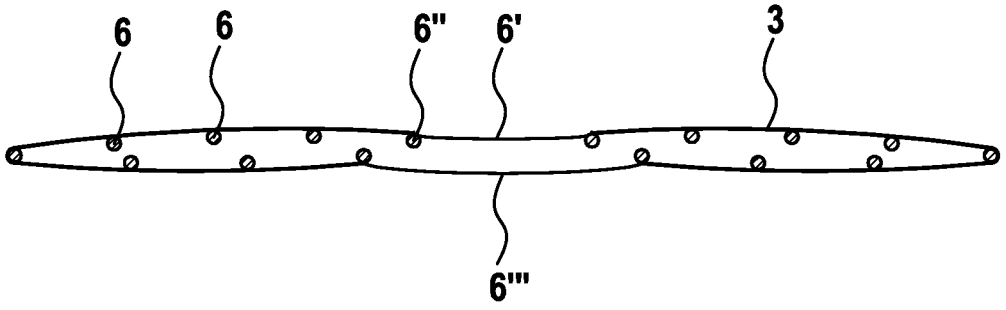

FIG. 1B shows a cross section of the exemplary lighting device 1 of FIG. 1A. In this cross section, for instance, the part of the housing 2 lying in the interior of the shade 3 is visible. Particularly, a lighting element 7 projecting from a bottom surface of the housing 2 is visible. Alternatively, a transparent surface area may be provided at the lower side of the housing 2 so that light from the lighting element arranged within the housing may be output via said transparent surface section. Also a combination of these alternatives is possible, i.e. the projecting lighting element 7 may be enclosed by a transparent surface section of the housing 2, projecting from the otherwise planar lower side of the housing.

Figure 7:
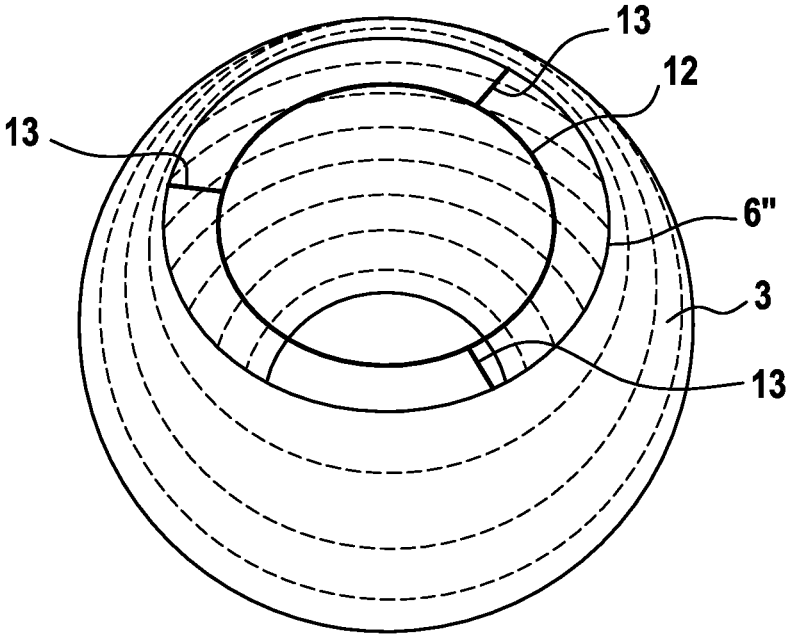
FIG. 7 shows a perspective view of an exemplary shade usable for a lighting device according to an embodiment of the invention.

As visible from FIG. 1B, the housing 2 is arranged within a top opening 6' of the shade 3. The shade 3 itself only rests loosely, via one of the support elements on an external surface of the housing 2. In the illustrated embodiment, the support element is a top support element 6". The top support element 6", thus, forms a mounting element. It is also possible, however, that the mounting element is distinct from the support elements, as illustrated in FIG. 7.

Since the shade 3 only rests loosely on an external surface of the housing 2, the shade 3 can be lifted and, thereby detached from the housing 2. In this way, it is easily possible to replace the shade 3 by another shade, which may be, for instance, differently colored, differently shaped, differently sized, etc.

Figure 1E:
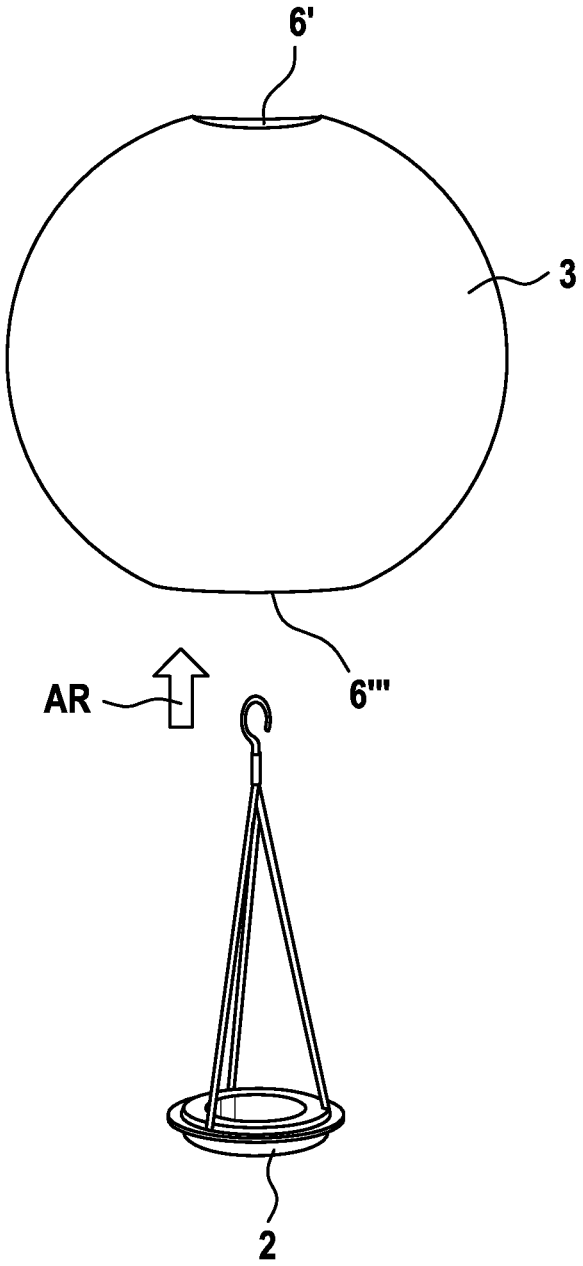
FIG. 1E shows the insertion of the housing into the shade, from below.

The shade 3 comprises a bottom opening 6'", the size of which is larger than the size of the top opening 6'. Particularly, the bottom opening 6'" may have a diameter that is larger than the diameter of the top opening 6'. Still more preferably, the bottom opening 6'" has a size, e.g. a diameter, that is larger than the size, e.g. the diameter, of the housing 2. Thereby, the housing 2 may, as indicated by arrow AR in FIG. 1E, easily be introduced into the shade 3 via the bottom opening 6'". In this way, it is possible to easily introduce the housing 2 via the bottom opening 6'" into the shade 3 until the top support element 6" surrounding the top opening 6' loosely rests on an external surface of the housing 2. Thereby, the shade 3 can be suspended from a roof or similar, as the shade 3 rests loosely on the housing 2 being provided with the suspension assembly 4'.

As can be seen from FIG. 10 the cords 4 of the suspension assembly 4' are attached to the housing 2 as well. To remove the shade 3, the shade 3 has to be lifted beyond the hook 5. Thus, even if the shade 3 only loosely rests on an external surface, having in FIG. 10 the form of a rim 9, of the housing 2, the shade 3 would not easily be completely removed from the housing 2 by accident, for instance, under the influence of wind. Preferably, the cords 4 are connected to the housing 2 adjacent to the external surface, i.e. the rim 9 in this embodiment, as shown in FIG. 10. Thereby, if the shade 3 is dislocated relative to the external surface, e.g. the rim 9, by action of wind, the cords 4, in particular their lower portions, will serve as directing structures 4" acting to return such temporarily dislocated shade 3 to its correct place, loosely resting on the external surface, e.g. the rim 9.

In addition to solar cells 11 and lighting element 7 (the latter is best shown in FIG. 1B) the housing 2 may additionally contain a rechargeable battery for storing solar power, an on/off button, a light sensor etc.

In the following, different embodiments of the housing 2 will be shown.

The housing may generally be cylindrically or conically shaped, wherein, additionally, a rim may project from a side surface of the cylinder or cone. As a consequence, the outer diameter of the housing may have at least two different sizes along an axis being perpendicular to the top opening of the shade or, in other words, perpendicular to the top surface of the housing. The top opening of the shade, again, may have a size or diameter that is smaller than the largest of the at least two different outer diameters of the housing. In this way, a connection between the shade and the housing can be achieved, wherein the shade only loosely rests on an outer surface of the housing.

As mentioned above, to "loosely rest on an external surface of the housing" according to the invention means that the shade is not fixed to the housing by means of any separate fixing elements such as hooks, snap-in connections, or clamping connections. It is, however, possible that in view of friction between the shade and the external surface of the housing, some additional force would be required to lift the shade from the external surface of the housing.

The shade 3 may particularly be removable from the housing 2 by moving the shade in a direction perpendicular to the top opening 6' of the shade 3. In said direction, particularly, no fixing elements or protruding parts of the housing 2 may be present that could impede the removal of the shade 3.

Figure 2:
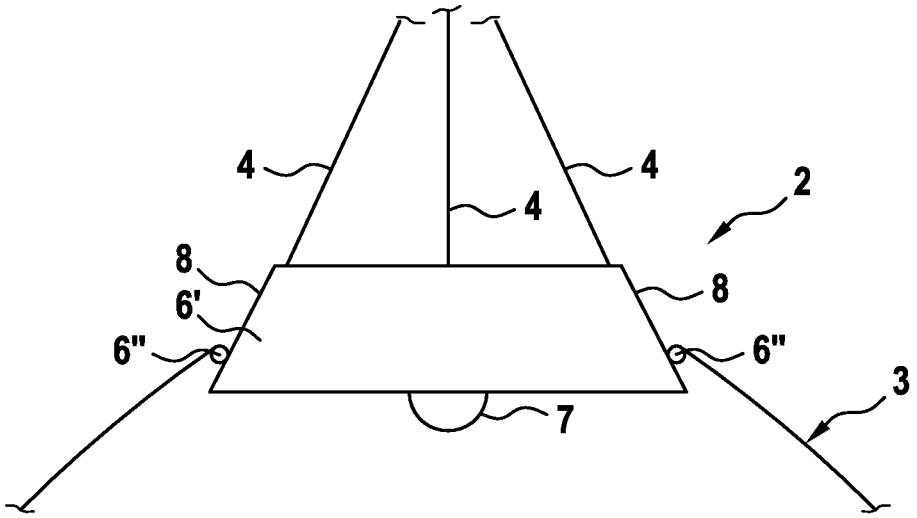
FIG. 2 shows a cross section of an exemplary housing of a lighting device according to an embodiment of the invention.

FIG. 2 illustrates an example of the housing 2 having an external surface in the form of a side surface 8 that tapers, particularly, in a direction away from the top opening 6' of the shade 3. In other words, the diameter of the housing 2 decreases with increasing distance from the top opening 6' of the shade 3. In this way, it is possible to easily mount the shade 3 to the housing 2 while at the same time achieving a good connection in the final mounting position of the shade 3. The housing 2 of this example, thus, has a conical shape.

The shade 3 itself is only schematically shown in this and the following figures. The uppermost, i.e. the top support element 6" of the shade 3 which acts as mounting element is shown. This mounting element 6", which is a circular ring in the embodiments shown, but which may have other shapes, such as oval, square, rectangular, triangular, etc. depending on the shape of the shade and/or the shape of the housing, rests loosely on the tapered side surface 8 of the housing 2.

Figure 3:
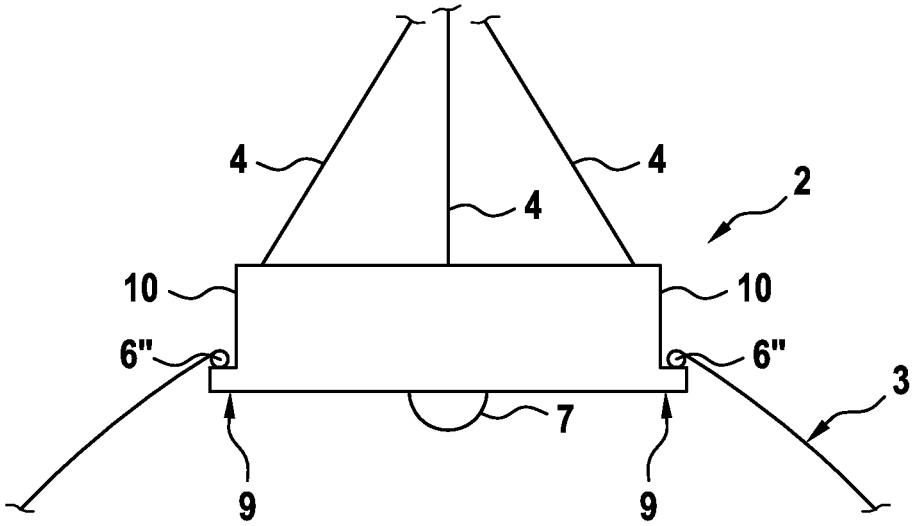
FIG. 3 shows a cross section of an exemplary housing of a lighting device according to an alternative embodiment of the invention.

FIG. 3 shows an alternative embodiment of the housing 2. In this case, the housing 2 is generally cylindrical. However, an external surface in the form of a rim 9 projects from a side surface 10 of the cylindrical housing 2. The shade 3, particularly the top support element 6" acting as a mounting element may loosely rest on said rim 9.

The rim 9 may be provided along the whole circumference of the housing 2. Alternatively, the rim 9 may be interrupted and only provided in certain circumferential areas of housing 2 (not shown). In the latter case, material for the rim may be saved. In this case, also the mounting element, particularly when being distinct from a support element of the shade, may be interrupted, particularly so as to match the form of the rim. In this case, the distance between neighboring parts of the rim may be smaller than a circumferential extension of each of the parts of the mounting element to allow for a reliable connection.

Figure 4:
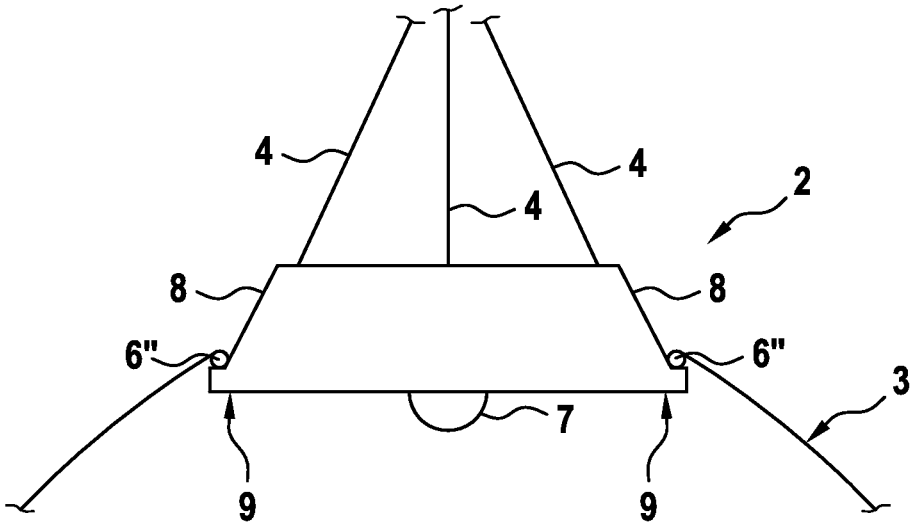
FIG. 4 shows a cross section of an exemplary housing of a lighting device according to a further embodiment of the invention.

FIG. 4 shows another alternative embodiment of an exemplary housing 2 of a lighting device according to the invention. In this case, an external surface in the form of a rim 9 projects from a conical side surface 8 of the housing 2. This embodiment, thus, may be seen as a combination of the embodiments shown in FIGS. 2 and 3. In this embodiment, the conical side surface 8 makes it easier for the top support element 6" of the shade 3 to find its correct position loosely resting on the rim 9 when introducing the housing 2 into the shade 3 (compare FIG. 1E).

Figure 5:
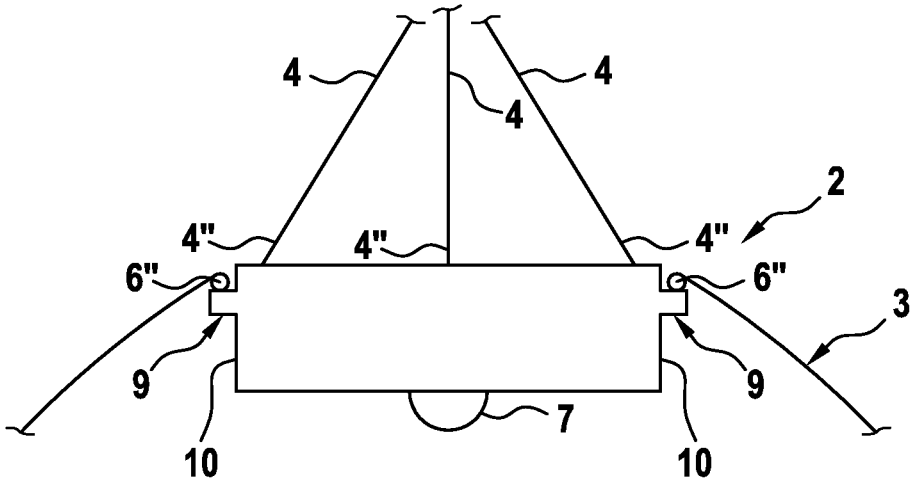
FIG. 5 shows a cross section of an exemplary housing of a lighting device according to yet another embodiment of the invention.

FIG. 5 shows a further example of a housing 2 for a lighting device according to an embodiment of the invention. The housing 2 of FIG. 5 is similar to the housing 2 of FIG. 3. However, the external surface in the form of the rim 9 is provided at an upper portion of the side wall 10 of the housing 2. Thus, the extension of the housing 2 on the side of the rim 9 facing the interior of the shade 3 is larger than the extension on the side facing away from the interior the shade 3. In this case, the cords 4, that are also schematically illustrated in FIGS. 2 to 4, are particularly useful in their function serving as directing structures 4" to avoid having the shade 3 unintentionally slip from the housing 2 and/or being dislocated from the rim 9, for instance, under the influence of wind.

Figure 6:
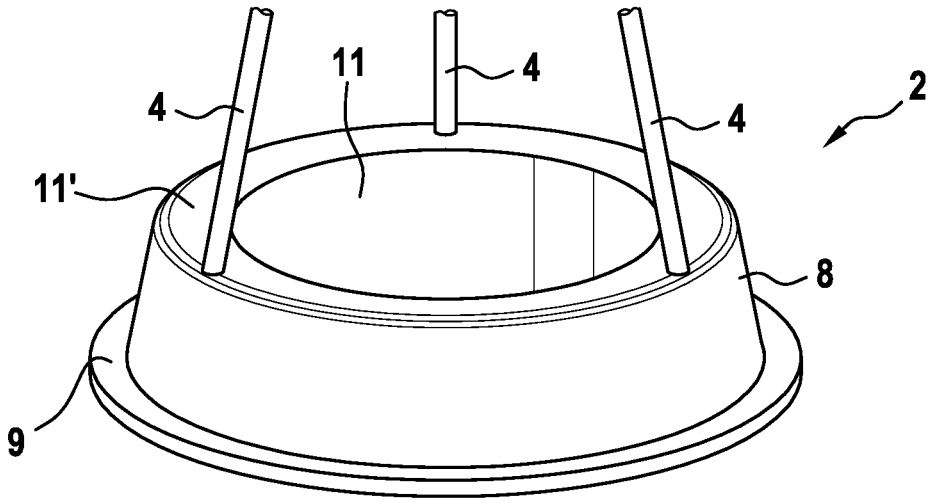
FIG. 6 show a perspective view of the exemplary housing illustrated in FIG. 4.

FIG. 6 shows a perspective view of the housing 2 of the embodiment shown in FIG. 4. At a top surface 11' of the housing 2, the housing 2 comprises an opening in which at least one solar cell 11 of the solar-power unit is arranged. The cords 4 are connected to the housing 2 in a surface area surrounding the at least one solar cell 11 of the solar-power unit. To be efficient as part of the directing structure 4", directing a potentially dislocated shade back to the external surface, the cords 4 are connected to the housing 2 adjacent to the external surface, having in this embodiment the form of the rim 9.

FIG. 7 shows a perspective view of an exemplary shade 3 usable for a lighting device according to an embodiment of the invention. For instance, the shade 3 may be used in combination with a housing 2 as illustrated in FIG. 10, 2, 3, 4, or 5. In this example, the mounting element 12, which is to rest loosely on the housing 2, is distinct from the support structure of the shade fabric. In particular, the mounting element 12 is spaced from the top support element 6" and connected thereto via three horizontal struts 13. The invention is not limited to three struts. Alternatively one, two or more than three struts may be used.

The space between the mounting element 12 and the fabric of the shade, has the following advantages. The wear on the fabric may be decreased as it is no longer in contact with the housing. Moreover, a more well-defined position of the mounting element 12 with respect to the housing is possible as there is no involvement of the fabric there. Finally, the space between the mounting element 12 and the supporting structure of the shade fabric offers a possibility for rain water to drain between the mounting element 12 and the fabric of the shade.

As indicated above, the shape of the mounting element 12 does not need to be ring-shaped. Other shapes adapted, for instance, to the shape of the top support element 6" or of the housing, are possible as well. For instance, the mounting element may be oval or rectangular in shape.

Figure 8:
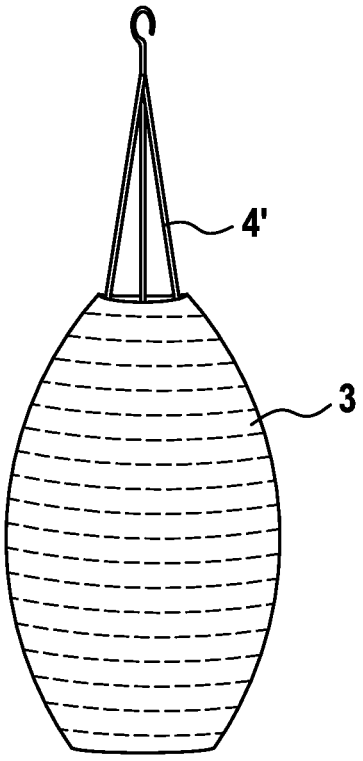
FIG. 8 shows a perspective view of a lighting device according to another embodiment of the invention.

FIG. 8 illustrates another embodiment of a lighting device 1 according to the invention. The embodiment generally corresponds to the embodiment of FIG. 1A, but with a different form of the shade 3. Instead of a globe shaped shade 3 as in FIG. 1A, the shade 3 of FIG. 8 has a vertically elongated or oval shape. The mounting element may be embodied as a separate element distinct from the supporting structure of the shade, as illustrated in FIG. 7. Alternatively, the mounting element may correspond to the top support element as illustrated, for instance, in FIG. 2. The shade 3 may be used in combination with a housing as illustrated in FIG. 10, 2, 3, 4, or 5, particularly since the mounting element may still be ring-shaped as the shade is only vertically elongated. The mounting element and the housing are not shown in FIG. 8, the suspension assembly 4' is only depicted schematically.

Not illustrated in the figures, the housing 2 of the exemplary lighting device may further include a switch and/or a light sensor to activate the lighting element dependent on the position of the switch and/or the ambient lighting conditions.

The housing 2 may further receive at least one rechargeable battery (not shown) electrically connected to the at least one solar cell 11 and the lighting element. The rechargeable battery may be chargeable via the at least one solar cell 11 and then usable to power the lighting element.

Although the previously discussed embodiments and examples of the present invention have been described separately, it is to be understood that some or all of the above-described features can also be combined in different ways. The above discussed embodiments are particularly not intended as limitations, but serve as examples, illustrating features and advantages of the invention.

The invention claimed is:

1. A lighting device comprising:

a housing including a solar-power unit, an external surface, and a lighting element, wherein the external surface extends around the housing; and a shade extending from the external surface of the housing;

wherein the shade comprises a shade fabric that is at least partly transparent, and a mounting element, wherein the shade has a top opening and a bottom opening, the bottom opening is larger than the top opening and larger than the housing;

wherein the mounting element of the shade is releasably connected to the housing and the mounting element loosely rests on the external surface around ef the housing when connected thereto so that the shade rests on the external surface of the housing without being fixed to the external surface of the housing by any kind of fixing element or fastener thereby permitting the shade to be removed or lifted from the external surface of the housing without a need to release any fixing element or fastener; and wherein the lighting device further comprises a suspension assembly for suspending the lighting device from a surface, wherein the suspension assembly is connected to the housing; and wherein the suspension assembly comprises a hanging device and a directing structure, wherein the directing structure comprises at least one cord extending from the hanging device to a location adjacent to the external surface of the housing, wherein the at least one cord is arranged to direct the shade toward the external surface of the housing in the case where the shade is dislocated from the external surface of the housing.

2. The lighting device according to claim 1, wherein the mounting element of the shade loosely rests on a rim projecting from a side of the housing.

3. The lighting device according to claim 2, wherein the side of the housing tapers in a direction away from the rim.

4. The lighting device according to claim 2, wherein the extension of the housing on a side of the rim facing the interior or the shade is larger than the extension on a side facing away from the interior of the shade.

5. The lighting device according to claim 2, wherein the side of the housing tapers conically in a direction away from the rim.

6. The lighting device according to claim 1, wherein the mounting element of the shade loosely rests on a tapering side surface of the housing.

7. The lighting device according to claim 1, wherein said mounting element of the shade is a ring.

8. The lighting device according to claim 7, wherein the ring is a top support element of the shade.

9. The lighting device according to claim 1, wherein said mounting element of the shade is distinct and spaced from a support structure of the shade.

10. The lighting device according to claim 1, wherein the suspension assembly comprises a hook connected to the housing via at least one cord.

11. The lighting device according to claim 1, wherein the housing is arranged at least partly within the top opening.

12. The lighting device according to claim 1, wherein the shade is a collapsible shade.

13. The lighting device according to claim 1, wherein the shade loosely rests on a conical side surface of the housing.

14. The lighting device according to claim 1, wherein the hanging device comprises a hook, and the at least one cord comprises at least two cords.

15. The lighting device according to claim 14, wherein the at least two cords are connected to the housing in a surface area surrounding at least one solar cell of the solar-power unit.

16. The lighting device according to claim 1, wherein the hanging device comprises a hook, and the at least one cord comprises at least three cords.

17. The lighting device according to claim 1, wherein the mounting element comprises a ring-shaped top support element, the external surface extends around the housing, and the ring-shaped top support element loosely rests on the external surface around the housing.

18. A lighting device comprising:

a housing including a solar-power unit, an external surface, and a lighting element;

a shade extending from the external surface of the housing; and a suspension assembly for suspending the lighting device from a surface, wherein the suspension assembly is connected to the housing;

wherein the shade is releasably connected to the housing and loosely rests on the external surface of the housing when connected to the housing; and wherein the suspension assembly comprises a hanging device and a directing structure, wherein the directing structure comprises at least one cord extending from the hanging device to a location adjacent to the external surface of the housing, wherein the at least one cord is arranged to direct the shade toward the external surface of the housing in the case where the shade is dislocated from the external surface of the housing.

* * * * *